US012607187B2

(12) United States Patent
Carl et al.

(10) Patent No.: US 12,607,187 B2
(45) Date of Patent: Apr. 21, 2026

(54) SLIDING VANE ROTARY PUMP

(71) Applicant: Busch Produktions GmbH, Maulburg (DE)

(72) Inventors: Stephan Carl, Lörrach (DE); Sebastian Schwenzer, Lörrach-Haagen (DE); Ronald Sachs, Schopfheim (DE)

(73) Assignee: Busch Produktions GmbH, Maulburg (DE)

( * ) Notice: Subject to any disclaimer, the term of this patent is extended or adjusted under 35 U.S.C. 154(b) by 0 days.

(21) Appl. No.: 19/118,828

(22) PCT Filed: Oct. 10, 2022

(86) PCT No.: PCT/EP2022/078009
§ 371 (c)(1),
(2) Date: Apr. 7, 2025

(87) PCT Pub. No.: WO2024/078678
PCT Pub. Date: Apr. 18, 2024

(65) Prior Publication Data

US 2026/0009385 A1 Jan. 8, 2026

(51) Int. Cl.
*F04C 18/344* (2006.01)
*F04C 29/02* (2006.01)

(52) U.S. Cl.
CPC ..... *F04C 18/3448* (2013.01); *F04C 29/02* (2013.01)

(58) Field of Classification Search
CPC .. F04C 18/3448; F04C 29/02; F04C 15/0088; F04C 29/021; F04C 27/001; F04C 2/344;
(Continued)

(56) References Cited

FOREIGN PATENT DOCUMENTS

| | | |
|---|---|---|
| DE | 202012002883 | 6/2013 |
| EP | 3470678 | 4/2019 |

(Continued)

OTHER PUBLICATIONS

English Translation WO-2013139570-A2 (Year: 2013).*

(Continued)

*Primary Examiner* — Shafiq Mian
(74) *Attorney, Agent, or Firm* — Tucker Ellis LLP

(57) ABSTRACT

The invention relates to a rotary vane pump (1) for conveying a fluid to be conveyed, with a housing (2), with a rotor receiving chamber (3) and a lubricant chamber (14). An eccentrically arranged rotor (4) is provided in a rotor receiving chamber (3) in such a way that at least one conveying chamber (11) is produced, the volume of which varies cyclically during rotation of the rotor (4). Furthermore, the rotary vane pump (1) has an intake channel (12) for feeding the fluid to be conveyed into the conveying chamber (11) and a discharge channel (13) for discharging the fluid to be conveyed out of the conveying chamber (11) in the direction of the lubricant chamber (14), wherein a valve device (21) is provided between the discharge channel (13) and the lubricant chamber (14) in order to prevent a backflow of fluid, in particular of lubricant and/or of fluid to be conveyed, from the lubricant chamber (14) into the conveying chamber (11). The rotary vane pump (1) is furthermore designed and set up in such a way that the discharge channel (13) is arranged in such a way that it opens into the lubricant chamber (14). Furthermore, the rotary vane pump (1) has at least one ventilation channel (26), which is fluidically connected by a conveying chamber end (28) to the conveying chamber (11) and fluidically connected by a ventilation end (27) to a chamber outside the conveying chamber (11), as well as at least one compensation channel (29), which is fluidically connected by a conveying chamber end (31) to
(Continued)

Figure 1:
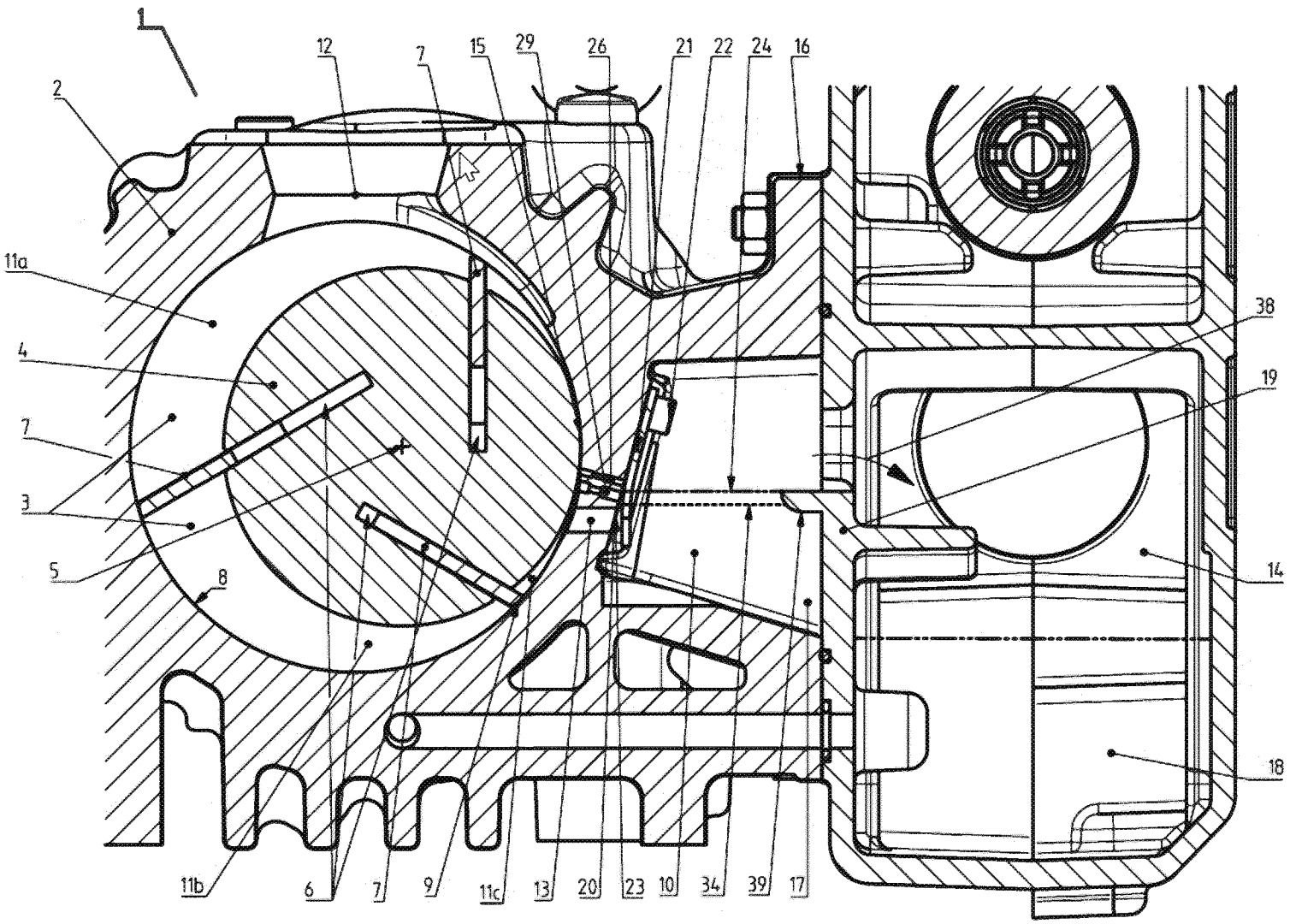

the conveying chamber (11) and fluidically connected by a compensation end (30) to the lubricant chamber (14). In this way, the rotary vane pump (1) is designed and set up in such a way that the compensation end (30) opens into the lubricant chamber (14) below the lubricant level (24) in an operating state of the rotary vane pump (1) and opens into the lubricant chamber (14) above the lubricant level (34) in a resting state of the rotary vane pump (1).

17 Claims, 3 Drawing Sheets

(58) Field of Classification Search
CPC .... F04C 18/3445; F04C 2/324; F01C 21/108; F01C 21/0863
See application file for complete search history.

(56) References Cited

FOREIGN PATENT DOCUMENTS

| | | | |
|---|---|---|---|
| WO | 2007006666 | 1/2007 | |
| WO | WO-2007006666 A1 * | 1/2007 | ..... F04C 29/128 |
| WO | 2013139570 | 9/2013 | |
| WO | WO-2013139570 A2 * | 9/2013 | ..... F04C 29/026 |

OTHER PUBLICATIONS

English Translation WO-2007006666-A1 (Year: 2007).*
International Search Report and Written Opinion in PCT/EP2022/078009, dated Jun. 13, 2023 (11 pages including translations).

* cited by examiner

SLIDING VANE ROTARY PUMP

The invention relates to a rotary vane pump for conveying a fluid to be conveyed.

Rotary vane pumps have a housing with a cavity in which a rotatable rotor is eccentrically arranged. Typically, slot-like recesses (often referred to as slide slots) are formed in the rotor, in which wall elements (so-called slides) are movably, in particular slidably, arranged. In a large number of designs, the wall elements/slides are pressed against an inner wall of the housing cavity (rotor receiving chamber) during rotation of the rotor due to centrifugal force. One or more conveying chambers are thus formed by means of the wall elements, with the volume of the conveying chamber(s) varying cyclically during rotation of the rotor. By means of suitably arranged intake and discharge channels, a fluid to be conveyed by the rotary vane pump can thus be conveyed from an intake channel to a discharge channel.

A lubricant, which is stored in a lubricant chamber of the rotary vane pump, is used to lubricate the parts that move mechanically against each other. Another task of the lubricant is to provide additional sealing between the inner wall of the housing interior and the wall elements, between the wall elements and the rotor, and between other components of the rotary vane pump.

Rotary vane pumps as such are well known in the state of the art and are used in a variety of applications. A typical field of application for such rotary vane pumps is the generation of a low pressure/vacuum, for example in scientific applications (in the latter case mostly as one link in a chain of different pump types (where the rotary vane pumps are typically used for the generation of a so-called fore-vacuum or rough vacuum).

Although rotary vane pumps have proven their usefulness and are widely used, they still have certain drawbacks.

A frequently criticized disadvantage of rotary vane pumps is their continuous noise generation. It is easy to understand that a reduction in the operating noise generated would be welcomed by many users.

Another problem exists with the shutdown of rotary vane pumps (whereby the shutdown can be planned—for example, through user intervention, or can also occur unplanned, for example, as a result of a malfunction). In this case, typical designs of rotary vane pumps tend to suck lubricant into the rotor receiving chamber or the conveying chambers. The volume of lubricant sucked in can then cause problems when the rotary vane pump is restarted, in particular cause increased operating noise, require increased drive torque, and/or cause increased mechanical resistance. The latter can lead in particular to increased mechanical wear and, under unfavorable conditions, even to damage to the rotary vane pump. It is easy to see that owing to the problems described above, but also owing to other problems not described in detail here, there is still a need for improvements in the construction of rotary vane pumps. Accordingly, it is not surprising that a large number of possible improvements have already been proposed in the prior art.

WO 2013/139570 A2 proposes, for example, a vacuum rotary vane pump in which a valve device is arranged between the discharge channel of the conveying chamber and the lubricant chamber of the rotary vane pump in order to prevent fluid from flowing back out of the lubricant chamber into the conveying chamber. The use of a compensation channel is suggested, which is connected to the discharge channel and the lubricant chamber and is integrated into the valve device. This is intended to provide rapid pressure equalization in the conveying chamber when the rotary vane pump is switched off, so that the conveying chamber is quickly brought to atmospheric pressure, thereby preventing the conveying chamber from filling up with lubricant via the lubricant supply. A different design for such an compensation channel between the conveying chamber and the lubricant is proposed in WO 2007/006666 A1

EP 3 470 678 A1 proposes to provide a compensation channel between the conveying chamber and the lubricant chamber of a rotary vane pump, wherein an opening of the compensation channel is arranged in the area of an overflow partition of the lubricant chamber.

Although such proposals absolutely have certain advantages, there nevertheless exists a need for further improvements.

The object of the present invention is thus to propose a rotary vane pump for conveying a fluid to be conveyed, which has an improved operating behavior.

A rotary vane pump for conveying a fluid to be conveyed is proposed, which comprises a housing with a rotor receiving chamber, a lubricant chamber, a rotor arranged eccentrically in the rotor receiving chamber, an intake channel for feeding the fluid to be conveyed into the conveying chamber and a discharge channel for discharging the fluid to be conveyed from the conveying chamber in the direction of the lubricant chamber. The rotor is arranged eccentrically in the rotor receiving chamber in such a way that there is at least one conveying chamber whose volume varies cyclically during rotation of the rotor. A valve device is provided between the discharge channel and the lubricant chamber to prevent fluid, in particular lubricant and/or fluid to be conveyed, from flowing back out of the lubricant chamber into the conveying chamber. The rotary vane pump is designed and equipped in such a way that the discharge channel opens into the lubricant chamber. The rotary vane pump has at least one ventilation channel, which, by a conveying chamber end, is fluidically in connection with the conveying chamber, and, by a ventilation end, is fluidically in connection with a space outside the conveying chamber. Furthermore, the rotary vane pump has at least one compensation channel, which, by a conveying chamber end, is fluidically in connection with the conveying chamber, and, by a compensation end, is fluidically in connection with the lubricant chamber. The rotary vane pump is designed and equipped in such a way that the compensation end of the compensation channel opens into the lubricant chamber below the lubricant level in an operating state of the rotary vane pump. In a resting state (or a switched-off state) of the rotary vane pump, the compensation end of the compensation channel opens into the lubricant chamber above the lubricant level.

At first glance, the design of the rotary vane pump with separate discharge channel, ventilation channel and compensation channel appears unnecessarily complex. However, the increased manufacturing expense—which is indeed the case—is generally more than compensated for by the associated advantages. This is because the separate design of the different channels (discharge channel, ventilation channel, compensation channel) makes it possible to optimize the relevant channel for the functionality to be realized in each case without this generally having any significant adverse effects on the other functionalities of the rotary vane pump, in particular on the functionalities of the other channels.

To give an example: the ventilation channel can be designed in particular with regard to the placement and/or the dimensioning of its conveying chamber end, with regard to the placement and/or the dimensioning of its ventilation end and/or with regard to its other geometry (in particular cross-sectional shape, cross-sectional size, fluid throttling devices, position, channel routing and the like) in such a way that it can (largely) optimally perform the ventilation function associated with it. Due to its at least partially separate design, this usually has no, or at most only minor, adverse effects on the other functionalities. In the case of the ventilation function, it must be ensured in particular that, on the one hand, the best possible noise reduction is achieved, but on the other hand that the pumping behavior of the rotary vane pump is not unduly adversely affected (in particular with regard to the achievable low pressure, efficiency losses due to inflowing fluid and the like). In this context, it should be noted for the sake of completeness that a compromise may have to be found with regard to optimum noise reduction and the least possible loss of pump efficiency. However, this compromise largely concerns only the ventilation functionality as such/the ventilation channel as such, but not the other remaining channels and their functionalities.

What has been said above with regard to the ventilation channel can also apply in an analogous manner to the other channels, in particular to the discharge channel and/or the compensation channel. In particular, the discharge channel usually requires a particularly effective pumping performance with regard to the fluid to be conveyed (especially when the fluid to be conveyed is expelled from the conveying chamber). In this case, a sufficiently large cross-sectional area must be selected for good conveying performance. However, an excessively large discharge channel can be disadvantageous in that the achievable vacuum quality can be reduced.

In particular, with regard to the compensation channel, the primary concern is usually to achieve the best possible sealing effect in an operating state of the rotary vane pump, combined with the fastest possible ventilation of the conveying chamber/rotor receiving chamber when or after the rotary vane pump is switched off and/or a sufficiently small volume of lubricant flowing into the conveying chamber/rotor receiving chamber when/after the rotary vane pump is switched off. In principle, the ventilation end of the ventilation channel can be in fluidic contact with essentially any areas. In particular, these can be areas which are largely under atmospheric pressure. Fluidic communication can take place with the environment (i.e. to the outside), but also with certain (internal) areas of the rotary vane pump, in particular with such (internal) areas of the rotary vane pump which are essentially at ambient pressure/atmospheric pressure (in particular in an operating state of the rotary vane pump). This can be, for example, a region of the lubricant chamber (or, if applicable, also of the lubricant bath and/or the lubricant supply chamber) that is (substantially) filled with a gas or a region of the lubricant chamber (or, if applicable, also of the lubricant bath and/or the lubricant supply chamber) that is (substantially) filled with a gaseous fluid.

For the sake of completeness, it is pointed out that an excessive amount of lubricant flowing into the conveying chamber/rotor receiving chamber can lead to a (too) high torque being required when restarting the rotary vane pump. Additionally or alternatively, damage or at least increased wear of the rotary vane pump can occur, which is naturally undesirable. An excessive amount of lubricant flowing into the rotor receiving chamber can also lead to lubricant leaking into the intake channel of the rotary vane pump, which can cause oiling of vacuum areas or vacuum equipment, where applicable.

In principle, any type of valve design is conceivable. In particular, passive valves, non-return valves, disk valves, seated valves and/or the like can be considered. When designing the valve device, a combination of low-cost construction, the highest possible sealing effect, long service life and high maxi-mum possible switching frequency should be considered.

In particular, it is possible to arrange the compensating end of the compensation channel and/or the ventilation end of the ventilation channel and/or the discharge end of the discharge channel in an area of the lubricant chamber that is substantially adjacent to the rotor receiving chamber or the conveying chamber. In particular, the relevant ends can be formed in a wall separating the lubricant chamber from the rotor receiving chamber or conveying chamber. In this way, a largely straight and/or relatively short compensation channel, ventilation channel or discharging channel can be realized. This can promote simple construction in particular, but can also be functionally advantageous.

In particular, it is possible for the conveying chamber end of the ventilation channel and/or the conveying chamber end of the compensation channel of the rotary vane pump to open directly into the conveying chamber of the rotary vane pump. In other words, separate openings (separate openings from each other) are provided for the separate channels (ventilation channel, compensation channel and/or discharge channel) towards the conveying chamber, i.e. in still other words, openings are provided which do not coincide or channels are provided which are not brought together and have a common conveying chamber opening/end towards the conveying chamber with a common channel section. The same also applies to the conveying chamber end of the discharge channel adjacent to the conveying chamber. The separate design makes it possible to optimize the respective conveying chamber ends, in particular their placement, cross-sectional shape and cross-sectional size, for the respective purpose. In initial tests, for example, it has proved advantageous if the respective conveying chamber ends are placed at different, i.e. in particular slightly offset, locations, especially along a circumferential direction of the rotor receiving chamber/the conveying chambers. For example, placing the conveying chamber end of the ventilation channel close to the dead center can achieve particularly effective noise reduction in conjunction with high efficiency of the rotary vane pump, while the conveying chamber end of the compensation channel is preferably placed somewhat further away from the dead center. First tests have shown that in particular the conveying chamber end of the ventilation channel (if necessary additionally or alternatively also the conveying chamber end of the compensation channel) should lie in the last third, preferably in the last quarter of the angular range of the respective conveying chamber, which results when one side of the respective conveying chamber meets the dead center. For example, if there are three conveying chambers in a rotor receiving area and the conveying chamber end of the relevant channel is to be located within the last third, the conveying chamber end should be arranged in an angular range of $360° \cdot \frac{1}{3} \cdot \frac{1}{3} = 40°$ before the dead center. With four conveying chambers, this would result in an angular range of $360° \cdot \frac{1}{4} \cdot \frac{1}{3} = 30°$ before the dead center. Additionally or alternatively, a different placement of the different conveying chamber ends (or of some of them) in axial direction may be used, in particular to allow a separation of the different conveying chamber ends despite (substantially) equal or only slightly different placements along the circumferential direction of the rotor receiving chamber. Further in addition or alternatively, it is also conceivable that at least some of the conveying chamber ends are arranged at (substantially) the same height as seen in the circumferential direction and/or in the axial direction. For the sake of completeness, it should be noted that it is of course also possible for at least some of the channels to be designed in such a way that the relevant channels are brought together at a distance from the conveying chamber/rotor receiving chamber, so that a common conveying chamber end/conveying chamber opening results to a certain extent. The latter form of design can lead in particular to a simplified construction, smaller installation space requirements and/or improved functionality of the rotary vane pump in question.

It is further proposed that in the rotary vane pump the compensation channel is arranged such that in an operating state of the rotary vane pump it opens into the lubricant chamber completely below the lubricant level of the lubricant chamber and preferably in a resting state of the rotary vane pump it opens into the lubricant chamber at least partially, preferably at least substantially completely, above the lubricant level. Such a design can in particular enable a high tightness of the compensation channel in an operating state of the rotary vane pump, combined with a good ventilation efficiency of the conveying chamber/rotor receiving chamber after a shutdown of the rotary vane pump. Furthermore, the quantity of fluid flowing into the conveying chamber/rotor receiving chamber (in particular lubricant, but also external fluid and/or fluid to be conveyed; also a mixture of different fluids, such as a mixture of lubricant and fluid to be conveyed) can be kept as low as possible in order to maintain, and possibly even increase, the effectiveness of the rotary vane pump. If—as preferably suggested—in a resting state (in particular shortly after a switching off or a shutdown of the rotary vane pump) the compensation end of the compensation channel opens into the lubricant chamber above the lubricant level, a particularly fast ventilation of the conveying chamber/rotor receiving chamber can be realized and/or the amount of lubricant flowing into the conveying chamber/rotor receiving chamber can be minimized. These are usually features that are desirable in rotary vane pumps.

It is furthermore proposed to design the rotary vane pump in such a way that the ventilation end of the ventilation channel opens into the lubricant chamber. The ventilation end of the ventilation channel can preferably open into the lubricant chamber above the lubricant level, in particular the lubricant level in the operating state of the rotary vane pump. In other words, the ventilation end of the ventilation channel can preferably open into a (at least substantially) gas-filled or into a (at least substantially) gaseous fluid-filled region of the lubricant chamber. This can effectively prevent unwanted contamination of the environment (outside space) by lubricant. The loss of lubricant from the rotary vane pump can also be reduced, which is also advantageous. In this context, it should be noted that any lubricant (e.g. in the form of a lubricant mist) entrained by the ventilation channel from the lubricant chamber into the conveying chamber/rotor receiving chamber is generally unproblematic, and in particular as a rule compared with the quantity of lubricant that is introduced via the compensation channel is negligible, (although the amount of lubricant entering the conveying chamber/rotor receiving chamber through the compensation channel is comparatively low thanks to the proposed design of the rotary vane pump).

Furthermore, it is proposed to design the rotary vane pump in such a way that the discharge channel is arranged in such a way that, in an operating state of the rotary vane pump, it opens into the lubricant chamber at least partially, preferably at least substantially completely, below the lubricant level of the lubricant chamber. This applies in particular to an operating state of the rotary vane pump; however, it may also apply to a resting state of the rotary vane pump. In this way, it is generally possible for the tightness of the valve device to be particularly high, so that the effectiveness of the rotary vane pump can be increased, and/or comparatively simply constructed and/or inexpensively manufactured valve devices can be used.

It is further proposed that in the rotary vane pump the lubricant chamber has a lubricant bath adjacent to the discharge channel and a lubricant storage area, the lubricant bath and the lubricant storage area preferably being separated from one another by means of a partition wall, preferably by means of an overflow partition wall. Thanks to this comparatively simple further development, it is possible in particular for the lubricant level in the lubricant bath to drop particularly quickly when the rotary vane pump is switched off, and thus in particular for the compensation end of the compensation channel to come to lie particularly quickly partly/mostly completely above the lubricant level (by lowering the lubricant level). In particular, this can greatly reduce the amount of lubricant entering the rotor receiving chamber via the compensation channel. By providing a lubricant storage area separate from the lubricant bath, the supply volume of lubricant (which can be conveyed, for example, via feed pumps and the like to the relevant areas of the rotary vane pump for lubrication of the various components) can be selected to be particularly large, so that in particular long operation of the rotary vane pump can take place without lubricant having to be replenished. In particular, this can extend maintenance intervals and/or reduce the probability of damage due to lubricant loss. Another advantageous feature of the partition is usually that it defines the lubricant level in the lubricant bath to a large extent, especially in an operating state of the rotary vane pump (an excess of lubricant runs off over the partition into the lubricant storage area, it being noted that lubricant is usually replenished via the discharge channel). In this way, the lubricant level relative to the compensation end of the compensation channel, to the ventilation end of the ventilation channel and/or to the discharge end of the discharge channel (first of all to the compensation end of the compensation channel) can be defined particularly easily and precisely both in the operating state and in the resting state of the rotary vane pump. For the sake of completeness, it is pointed out that in general the lubricant level of the lubricant bath is higher than the lubricant level of the lubricant storage area, especially in an operating state of the rotary vane pump, but often also in a switched-off state of the rotary vane pump.

It is possible that the partition wall has at least one drain opening and/or at least one recess in the area of the upper edge of the partition wall. The number and the size of the recesses in the area of the upper edge of the partition wall and/or the drain openings should be selected in such a way that the quantity of lubricant draining through these recesses/drain openings is compensated for by subsequently conveyed lubricant under all operating conditions realistically to be expected in an operating state of the rotary vane pump. As a rule, a safety margin must be taken into account. The discharge openings can be designed in particular as through-holes in the partition wall. The proposed design can in particular promote a particularly rapid drop in the lubricant level in the area of the lubricant bath when the rotary vane pump switches from an operating state to a resting state. This in turn can reduce the amount of lubricant that enters the rotor receiving chamber/conveying chamber when the rotary vane pump is switched off.

It is also proposed that at least one volume-reducing device, in particular a bead device, is provided in the lubricant chamber, in particular in the lubricant bath, especially preferably in an upper filling level region of the lubricant chamber and/or the lubricant bath. In this way, for example, the cross-section of the lubricant bath can be reduced in its upper filling level region (especially in the region of the upper edge of the partition wall). An upper level range can be understood in particular as the range between the lubricant level when the rotary vane pump is switched on and the lubricant level when the rotary vane pump is switched off. This makes it possible to further accelerate the drop in the lubricant level during a transition of the rotary vane pump from an operating state to a resting state. Accordingly, the amount of lubricant entering the rotor receiving chamber/conveying chamber can be reduced even further. The bead device can be arranged in particular in the area of the upper edge of the partition wall on the partition wall. In addition or alternatively, it is also possible for the partition wall to be curved so that the cross-section of the lubricant bath tapers towards the top Furthermore, it is proposed to design the rotary vane pump in such a way that the valve device is at least partially designed as a valve tongue device. In particular, a valve device or a valve tongue device can also have several valve tongue areas. This allows a comparatively simple and cost-effective design of the valve device. Particularly in conjunction with at least partial immersion of the valve device in the lubricant chamber/lubricant bath, it is generally possible to achieve a particularly high sealing effect of the valve device.

When designing the rotary vane pump, it is possible—and often preferred—to provide a plurality of intake channels, discharge channels and/or valve devices and/or valve tongue devices and/or ventilation channels and/or compensation channels and/or conveying chambers and/or rotors and/or rotor receiving chambers. In this way, the functionality of the rotary vane pump can generally be significantly increased. In particular, it is possible to improve the pumping performance, the achievable pressures, the noise and/or the ventilation after a switching off/shutdown of the rotary vane pump. However, it is noted that the rotary vane pump can also have exactly one rotor receiving chamber, one rotor, one conveying chamber, one intake channel, one discharge channel, one valve device, one compensation channel and/or one ventilation channel. However, it is also conceivable that one, a plurality or all of the elements mentioned can occur several times (in particular twofold, threefold, fourfold, fivefold or sixfold). In this context, reference is also made to the possibility of "mixed combinations", for example in such a way that a rotary vane pump with a rotor and a rotor receiving chamber can have, for example, three conveying channels, two intake channels, four discharge channels, a valve device (in particular a valve device with several valve areas, such as in particular valve tongue areas), a ventilation channel and two compensation channels. Of course, other combinations are also conceivable.

It is also proposed that at least one ventilation channel and/or at least one compensation channel in the rotary vane pump has at least one fluid flow rate limiting device, in particular at least one throttling device. This can further increase the functionality of the channel in question. If the fluid flow rate limiting device is also designed to be variable and/or interchangeable (in each case in particular with regard to the realizable fluid flow rate), it is also possible to adapt the rotary vane pump particularly easily for different areas of application/use cases. For example, by using a different throttling device, the rotary vane pump can be adapted for use with a different lubricant (for example, different viscosity) without requiring excessively costly adaptation work.

Another conceivable design of the rotary vane pump is when at least one valve device of the rotary vane pump is designed as a completely sealing valve device, in particular in such a way that at least one valve tongue area of the valve device is designed to be essentially free of recesses. In this way, the effectiveness of the rotary vane pump can generally be further increased. In particular, pumping losses and/or a reduced pressure/vacuum quality can generally be avoided. It should be noted that functionalities such as ventilation during operation to reduce noise and/or ventilation of the rotor receiving chamber/conveying chambers of the rotary vane pump when the rotary vane pump is switched off are realized by devices (compensation chamber/ventilation channel) specially provided and designed for this purpose, whereby these can be optimized for the functionality to be achieved in each case. In a certain sense, the proposed design can also be understood in the sense that the valve device is or can be optimized for its intended use, namely in the sense that it allows fluid to flow in (substantially) only one direction.

Another embodiment of the rotary vane pump is when the dimensioning of the rotary vane pump, in particular the volume of the lubricant chamber, especially preferably the volume of the lubricant bath, is selected in such a way that a lowering of the lubricant level during the transition from the operating state to the resting state of the rotary vane pump is realized by an initial lubricant transfer from the lubricant chamber and/or the lubricant bath via the compensation channel into the conveying chamber/rotor receiving chamber, wherein the maximum lubricant transfer (in particular with regard to the volume) into the conveying chamber is dimensioned in such a way that a restart of the rotary vane pump is not significantly adversely affected, in particular substantially not adversely affected, by the lubricant present in the conveying chamber. In addition or alternatively, the maximum lubricant transfer (in particular with regard to the volume) in the conveying chamber should be dimensioned in such a way that a release of lubricant in the area of the intake channel or into the in-take channel is reduced, in particular minimized or at least essentially prevented. In this way, the functionality desired for rotary vane pumps when the rotary vane pump is switched off/shut down (transfer of the rotary vane pump from an operating state to a resting state) can be achieved by means that are comparatively simple and inexpensive to implement. In particular, the volume of transferred lubricant should be so minimal that no undesirably high drive torque is required when restarting the rotary vane pump and/or no increased wear occurs and/or no damage to the mechanical components (in particular wall elements/sliders or the like) occurs (at least under realistically expected operating conditions).

In particular, it is proposed that the rotary vane pump is designed and arranged in such a way that the relative arrangement of lubricant level in the lubricant chamber and/or in the lubricant bath, on the one hand, and discharge channel and/or compensation end of the compensation channel, on the other hand, (exclusively) results from a (height/level) variation of the lubricant level. Such a variation of the lubricant level can be realized in particular by suitable dimensioning of the lubricant chamber/lubricant bath. This makes the desired functionality particularly easy to implement technically. In particular, no moving mechanical components need to be provided for this purpose, for example.

In particular, it is proposed that in the rotary vane pump the at least one conveying chamber is at least partially delimited by wall elements that able to be shifted and/or pivoted relative to the rotor. In particular, a displaceability of wall elements (often referred to as sliders) with respect to the rotor can be realized by the wall elements being displaceable mounted in correspondingly formed receiving slots (often referred to as slider slots) in the rotor. It is thereby pointed out that mechanical wear can be reduced through a relative movement between the rotor and wall element(s) with the aid of the lubricant. Typically, this form of construction results in a number of 2, 3, 4, 5, 6, 7, 8, 9, 10 or more conveying chambers (in particular per rotor receiving area), although what has been said is not necessarily limited to this embodiment.

Furthermore, it is proposed that the ventilation channel of the rotary vane pump, in particular the fluid flow rate limiting device of the ventilation channel, is dimensioned in such a way that, in an operating state of the rotary vane pump, a noise reduction is realized without significantly impairing the delivery rate of the rotary vane pump. This is also a particularly desirable operating behavior, as a rule, for the rotary vane pump. Thanks to the proposed design of the rotary vane pump put forward here, this particularly desirable operating behavior of the rotary vane pump can be technically realized with comparatively simple means.

It is further proposed that in the rotary vane pump the compensation channel, in particular the fluid flow rate limiting device of the compensation channel, is dimensioned in such a way that sufficient ventilation of the conveying chamber during shutdown of the rotary vane pump is realized without significant impairment of the operating state by lubricant flowing back through the compensation channel and/or fluid to be conveyed. This is also a particularly desirable operating behavior for rotary vane pumps. Once again, thanks to the design of the rotary vane pump proposed here, this desired operating behavior of the rotary vane pump can be readily achieved with comparatively simple means.

Figure 2:
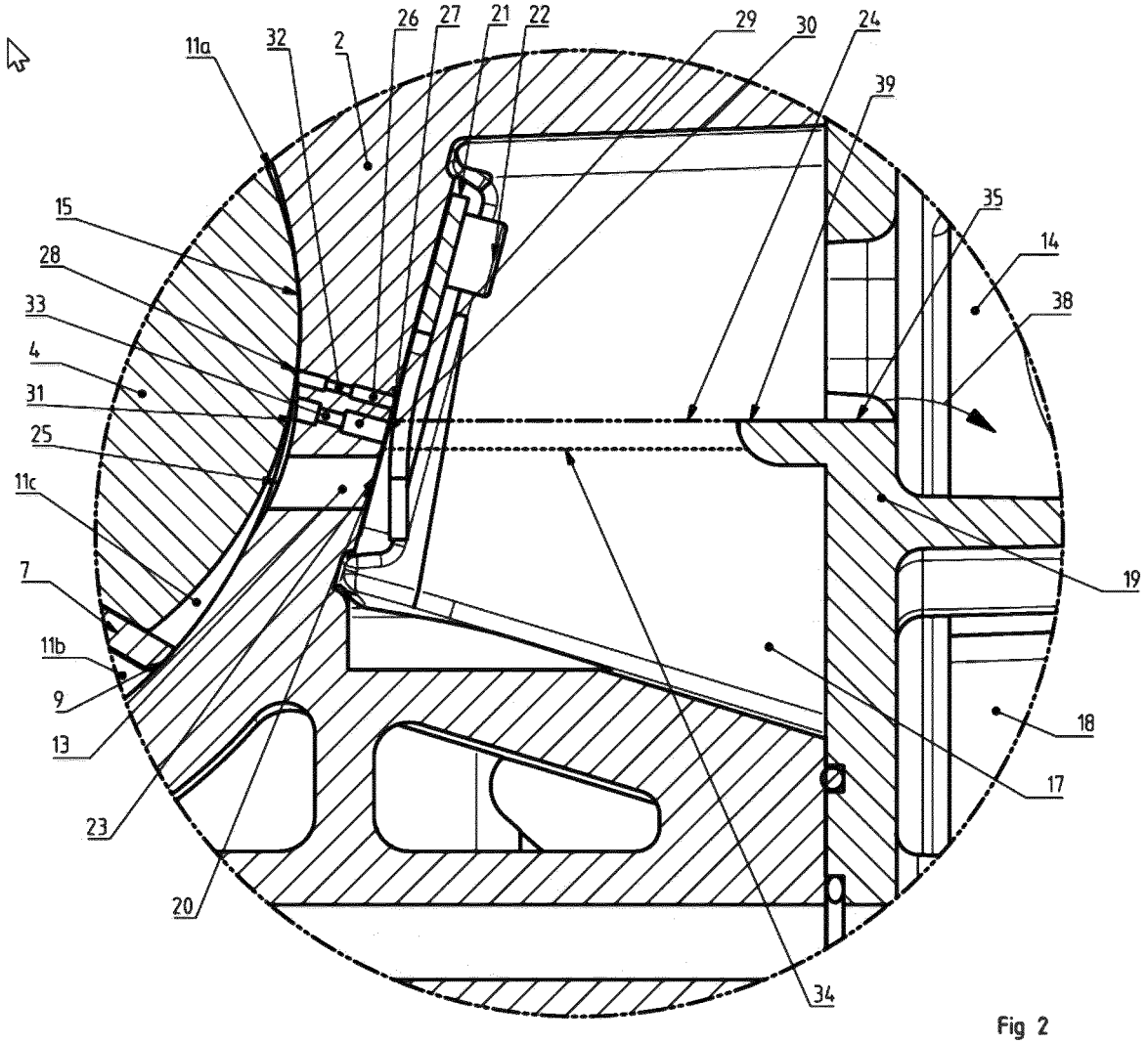
Figure 3:
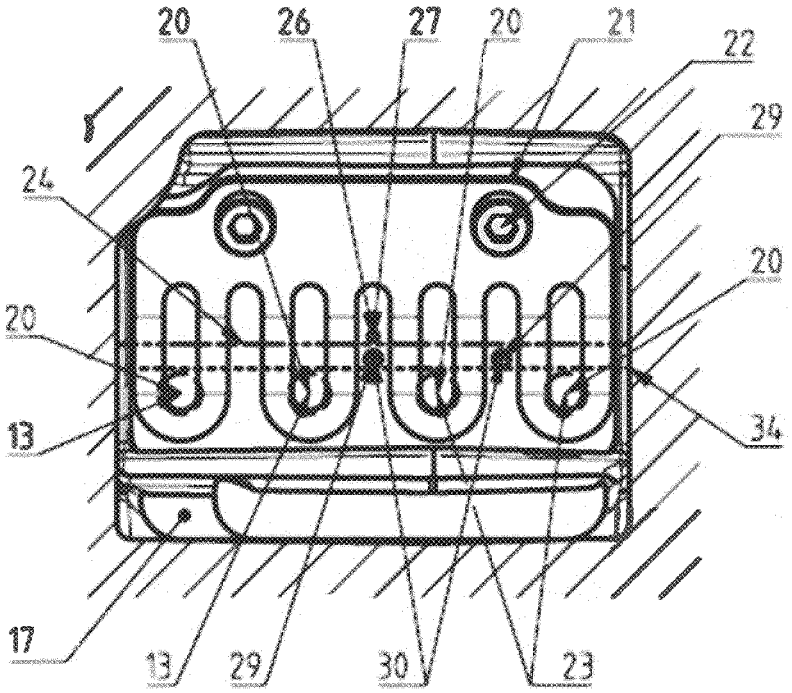
Figure 4:
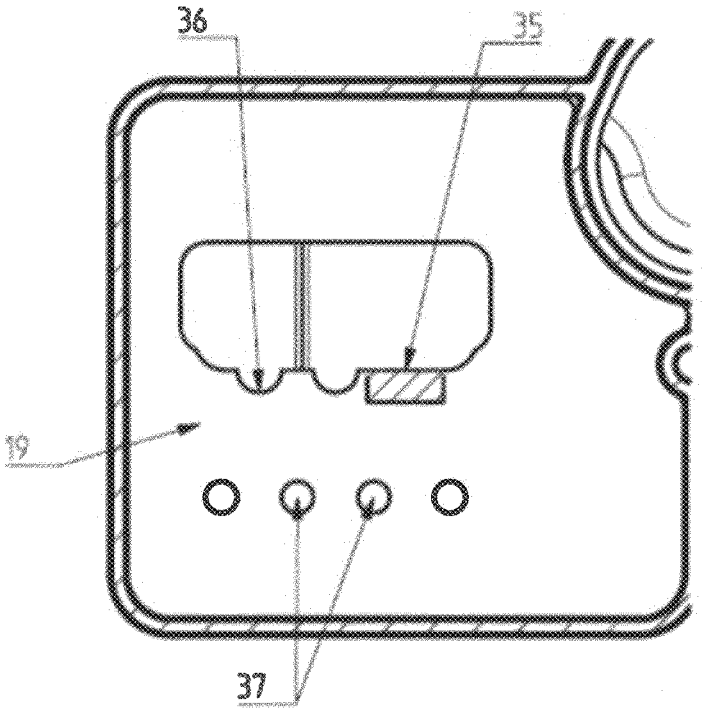

Further advantages, features and functions of the invention emerge from the following detailed description of the invention in combination with the corresponding drawings. The drawings show:

FIG. 1, a schematic cross-sectional view of a rotary vane pump with laterally arranged lubricant chamber;

FIG. 2, an enlarged detail of FIG. 1 in the region of discharge channel, ventilation channel and compensation channel;

FIG. 3, a lateral top view of the region with the valve tongue device of the rotary vane pump shown in FIG. 1;

FIG. 4, a lateral top view of an overflow partition wall in the lubricant chamber of the rotary vane pump shown in FIG. 1.

Shown in FIG. 1 in a schematic cross-sectional view is a rotary vane pump 1. Such rotary vane pumps 1 are known from their basic structure in the state of the art and are used for a variety of applications.

The rotary vane pump 1 has a housing 2, in which a hollow space—the rotor receiving chamber 3—is formed. Disposed in the rotor receiving chamber 3 in an eccentrically offset way is a rotor 4, which can be set in rotational movement along a rotational axis 5. In the embodiment example shown, the rotor 4 has three slide slots 6, in each of which a wall element 7 (often also referred to as a slide, vane or slide blade) is arranged so as to be displaceable relative to the rotor 4 in such a way that the wall elements 7 rotate together with the rotor 4. Through the rotation of the rotor 4 about the rotational axis 5, the wall elements 7, owing to the centrifugal force, are pressed against an inner wall 8 of the rotor receiving chamber 3. With the aid of a lubricant 10, the mechanical friction between the front ends 9 of the wall elements 7 and the inner wall 8 of the rotor receiving chamber 3 is reduced, and thus the attrition of the rotary vane pump 1 significantly decreased. At the same time, the lubricant film between the front ends 9 of the wall elements 7 and the inner wall 8 of the rotor receiving chamber 3 produces a sealing function, so that no fluid to be conveyed is able to flow by here.

The wall elements 7 divide the rotor receiving chamber 3 (taking into account the rotor 4) into three conveying chambers 11, namely conveying chambers 11*a*, 11*b* and 11*c*. Due to the current position of rotor 4 and dead center 15, conveying chamber 11*c* can be further divided into two sub-conveying chambers 11*c*, 11*c*' separated by the dead center. Due to the eccentric arrangement of the rotor 4 in the rotor receiving chamber 3, the volume of the conveying chambers 11 varies cyclically in the course of a rotation of the rotor 4 of the rotary vane pump 1, so that a fluid can be conveyed.

The fluid to be conveyed is drawn via an intake opening 12 into one of the three conveying chambers 11 (currently conveying chamber 11*a* and possibly also conveying chamber 11*c*'). The conveying chamber 11 in question is—as already mentioned—bounded by two adjacent wall elements 7. Due to the initial expansion of the respective conveying chamber 11, fluid to be conveyed is sucked into the respective conveying chamber 11 (conveying chamber 11*a*). After the respective conveying chamber 11 is separated from the intake opening 12 by the rotation of the rotor 4 from a certain angular position, its volume is reduced again due to the shape of the rotor receiving chamber 3 and the rotor 4 arranged eccentrically therein, so that the fluid contained therein is compressed (conveying chamber 11*b*). From a certain angular position of the rotor 4 or the respective conveying chamber 11, a fluidic connection to the discharge channel 13 is established and the fluid to be conveyed is ejected from the conveying chamber 11 via the discharge channel 13 into the lubricant chamber 14 (conveying chamber 11*c*). The ejection of the fluid into the lubricant chamber 14 takes place via the valve tongue device 21, which opens when the pressure in the conveying chamber 11 is slightly higher than the pressure in the lubricant chamber 14 (typically close to atmospheric pressure). The described cycle then starts again from the beginning. Mention should be made of the so-called dead center 15, which separates the area of the rotor receiving chamber 3 adjacent to the discharge channel 13 from the area of the rotor receiving chamber 3 adjacent to the intake opening 12.

The lubricant chamber 14 is connected via a flange area 16 to the area of the housing 2 of the rotary vane pump 1 in which the rotor receiving chamber 3 is formed with the rotor 4. In the present embodiment, the lubricant chamber 14 has two different areas. These are the lubricant bath 17 arranged adjacent to the discharge channel 13 and the lubricant storage area 18 designed separately therefrom. Lubricant bath 17 and lubricant storage area 18 are separated from each other by a partition wall, which is designed as an over-flow partition wall 19.

The discharge end 20 facing the lubricant bath 17 is connected to the lubricant bath 17 via a valve device, which in this case is designed as a valve tongue device 21. The valve tongue device 21 is connected to the housing 2 of the rotary vane pump 1 by means of screws 22, for example. In the embodiment example shown here, the valve tongue device 21 has four elastic valve tongue areas 23 (see also view according to FIG. 3), which cover the respective discharge ends 20 of the discharge channels 4 <sic. 13>, which are also arranged next to each other in the axial direction of the axis of rotation 5 of the rotor 4. Thanks to the elastic valve tongue areas 23, the fluid to be conveyed by the rotary vane pump 1 can only flow from the rotor receiving chamber 3 in the direction of the lubricant chamber 14—but not in the reverse direction.

In the case under consideration, the rotary vane pump 1 is designed in such a way that the discharge ends 20 of the discharge channels 13 open into the lubricant bath 17 in an operating state of the rotary vane pump 1 below the lubricant level 24 in the operating state of the rotary vane pump 1. This has the advantage that the lubricant 10 in the lubricant bath 17 exerts a certain fluid pressure on the elastic valve tongue areas 23, and thus the discharge ends 20 of the discharge channels 13 are securely closed (fluid-tight) by the valve tongue areas 23. Thereby the ambient pressure in the lubricant chamber 14 naturally exerts a pressure on the lubricant 10 in the lubricant bath 17. In addition, the lubricant 10 causes a certain sealing of any gaps and cracks that may be present, so that the tightness of the valve tongue device 21 is also particularly high as a result.

As can be seen in particular from the enlarged view in FIG. 2, in the present embodiment example shown of a rotary vane pump 1, in addition to the discharge channels 13, there is also a ventilation channel 26 which is in the present case completely separate from the discharge channel 13, as well as (in the present case) two compensation channels 29—also designed completely separate from the discharge channel 13 and the ventilation channel 26.

The ventilation channel 26 has a ventilation 27 which opens into the lubricant chamber 14 (or the lubricant bath 17) above the lubricant level 24 in the operating state of the rotary vane pump 1. The conveying chamber end 28 of the ventilation channel 26 is arranged at a suitable location in the rotor receiving chamber 3, preferably directly adjacent to the dead center 15. Thanks to the ventilation channel 26, a small amount of air or a small amount of fluid (in particular gaseous fluid) present in the lubricant chamber 14 can flow into the compression area of the rotor receiving chamber 3. This leads to a reduction in noise development, in particular at rotational speeds of the rotor 4 which lie in a limit range. Since the ventilation opening 26 can be optimized for the purpose of noise reduction, a partly significant noise reduction can be realized with a comparatively small construction effort, without other advantageous properties of the rotary vane pump 1 (which will be explained in more detail in the following) being adversely affected to a significant extent.

In particular, it is possible to provide the ventilation channel 26 with a suitably dimensioned throttle 32. In addition, it is also possible to make the throttle 32 interchangeable, so that the rotary vane pump 1 can be quickly adapted to different operating environments and for different purposes (also retroactively).

Furthermore, in the embodiment example shown here, two compensation channels 29 are provided, which are arranged at the same height, but axially offset to each other (with respect to the axis of rotation 5 of the rotor 4) (see also view in FIG. 3). Of course, a different number of compensation channels 29 is also possible (which, by the way, also applies to the ventilation channels 26).

The compensation ends 30 of the compensation channels 29 are arranged in such a way that they lie just below the lubricant level 24 of the lubricant bath 17 in the operating state of the rotary vane pump 1. As a result, a certain sealing effect is realized by the lubricant 10 in the lubricant bath 17, so that only a minor (net) fluid throughput (if any) occurs through the outlet channels 29 during operation of the rotary vane pump 1. This applies both to a flow of fluid to be conveyed out of the rotor receiving chamber 3 in the direction of the lubricant chamber 14 and to a flow of fluid (in particular lubricant 10) out of the lubricant chamber 14 or out of the lubricant bath 17 in the direction of the rotor receiving chamber 3.

It is particularly noteworthy with regard to the arrangement of the compensation ends 30 of the outlet channels 29 that these are located completely below the lubricant level 24 in the operating state of the rotary vane pump 1, but only just below the lubricant level 24 in the operating state of the rotary vane pump 1. This is relevant because after a shutdown of the rotary vane pump 1 (whether intentional or unintentional), the compensation channels 29 should be exposed as quickly as possible. The lubricant level in the lubricant bath 17 should therefore drop as quickly as possible to a lubricant level 34 when the rotary vane pump 1 is switched off (indicated by a dashed line in FIGS. 1 to 3). This will be discussed in more detail below.

In an operating state of the rotary vane pump 1, a fluid to be conveyed that is enriched with the lubricant 10 (suction of the fluid to be conveyed via the intake port 12) is conveyed by means of the cyclically increasing and decreasing conveying chambers 11 from the conveying chamber 11 (in this case conveying chamber 11*c*) located adjacent to the discharge channel 13 into the discharge channel 13. Due to the resulting pressure, the elastic valve tongue areas 23 of the valve tongue device 31 are pressed away from the wall of the flange area 16 so that the lubricant-fluid mixture enters the lubricant bath 17 or the oil chamber 14. This continuous flow of lubricant-fluid mixture (and thus also of lubricant 10) keeps the lubricant level 24 in the operating state of the rotary vane pump 1 in an upper range. The upper lubricant level 24 is essentially defined by the upper edge 35 of the overflow partition 19. The function of the optional recesses 36 in the area of the upper edge 35 of the overflow partition 19 and the optional drain openings 37 in the overflow partition 19 will be discussed below. In any case, recesses 36 and drain openings 37—if present—are to be dimensioned with regard to number and size in such a way that the lubricant level 24 in the operating state of the rotary vane pump 1 remains in the region of the upper edge 35 of the overflow partition 19 in all realistically expected operating states of the rotary vane pump 1, whereby a rise of the lubricant level 24 above the upper edge 35 of the overflow partition 19 takes place by overflow 38 of the lubricant 10 (indicated in FIGS. 1 and 2 by an arrow 38), the overflow 38 causing the lubricant 10 to flow from the lubricant bath 17 into the lubricant storage area 18 of the lubricant chamber 14.

Lubrication of the rotary vane pump 1, in particular in the area of the rotor 4 or the rotor receiving chamber 3, can be realized by lubricant pumps not shown here, which for example release lubricant 10 in the area of the intake port 12 of the rotary vane pump. Such lubricant pumps as well as such a lubrication of the rotary vane pump 1 are known as such in the prior art.

When the rotary vane pump 1 stops (for example, due to an intended shutdown process, but also due to an unintentional failure), air or fluid (in particular predominantly gaseous fluid) is drawn out of the lubricant chamber 14 into the rotor receiving chamber 3 via the ventilation channel 26, on the one hand. In addition, lubricant 10 initially flows from the lubricant bath 17 into the rotor receiving chamber 3 via the compensation channel 29. Since, due to the stopping of the rotary vane pump 1, there is no "replenishment" of lubricant 10 into the lubricant bath 17 (via the discharge channels 13), the initial lubricant level 24 in the operating state of the rotary vane pump 1 quickly drops to the lowered lubricant level 34 in the switched-off state of the lubricant pump 1. Accordingly, the compensation ends 30 of the compensation channels 29 are now exposed, so that air or substantially gaseous fluid is now drawn from the lubricant chamber 14 into the rotor receiving chamber 3. This allows the pressure in the rotor receiving chamber 3 to be equalized particularly quickly. Since the rotor receiving chamber 3 can thus be brought to ambient pressure (typically atmospheric pressure) particularly quickly, it can be ensured that only minimal quantities of lubricant enter the rotor receiving chamber 3. This is an advantageous way to prevent the rotor receiving chamber 3 from filling up with lubricant.

A rapid lowering of the lubricant level from the operating state level 24 to the switched-off level 34 can be accelerated by optional recesses 36 in the area of the upper edge 35 of the overflow partition wall 19 and/or by drain openings 37 in the overflow partition wall 19. The number and size of the recesses 36 and/or drain openings 37 can be selected in such a way that the amount of lubricant draining through these recesses/openings is compensated for under all realistically expected operating conditions in an operating state of the rotary vane pump 1 (usually plus a safety margin). To enable the rotary vane pump 1 to be adapted to different applications and/or operating conditions, the recesses 36 and/or the drain openings 37 can be designed to be reversibly closable, for example by providing an internal thread (especially in the case of the drain openings 37) or by the possibility of a slip-on discharge edge (especially in the case of recesses 36 in the area of the upper edge 35).

Furthermore, in the embodiment example shown, a bead 39, which is also optional, is attached in the area of the upper edge 35 of the overflow partition wall 19. This tapers the cross-section (horizontal cross-section in the view of FIG. 1 and FIG. 2) so that a reduced volume of lubricant 10 is sufficient to lower the lubricant level in the operating state 24 to the lubricant level in the switched-off state 34 of the rotary vane pump 1 (compared to the situation without bead 39). The bead 39 also increases the effectiveness of the recesses 36 and/or the drain openings 37 (if any).

Furthermore, it is possible that only individual elements (or also a certain subset of the described features) of the embodiment example described in detail of the rotary vane pump 1 described here are picked out and combined with the generic description of the presently proposed rotary vane pump.

The invention claimed is:

1. Rotary vane pump for conveying a fluid to be conveyed, a housing with a rotor receiving chamber and a lubricant chamber, a rotor arranged eccentrically in the rotor receiving chamber to form a conveying chamber whose volume varies cyclically when the rotor rotates, an intake channel for supplying the fluid to be conveyed into the conveying chamber and a discharge channel for discharging the fluid to be conveyed out of the conveying chamber in a direction of the lubricant chamber, a valve device provided between the discharge channel and the lubricant chamber configured to prevent a backflow of fluid out of the lubricant chamber into the conveying chamber, wherein the discharge channel is configured to open into the lubricant chamber, a ventilation channel connected fluidically by a first conveying chamber end thereof to the conveying chamber, and connected fluidically by a ventilation end thereof to a chamber outside the conveying chamber, and a compensation channel connected fluidically by a second conveying chamber end thereof to the conveying chamber, and connected fluidically by a compensation end thereof to the lubricant chamber, whereby the rotary vane pump is configured to open the compensation end into the lubricant chamber below a lubricant level in an operating state of the rotary vane pump, and to open into the lubricant chamber above the lubricant level in a resting state of the rotary vane pump.

2. Rotary vane pump according to claim 1, wherein the first conveying chamber end of the ventilation channel and/or the compensation end of the compensation channel open(s) directly into the conveying chamber of the rotary vane pump.

3. Rotary vane pump according to claim 1, wherein the compensation channel is arranged such that in the operating state of the rotary vane pump, said compensation channel opens into the lubricant chamber completely below the lubricant level of the lubricant chamber, and in the resting state of the rotary vane pump said compensation channel opens into the lubricant chamber at least partially above the lubricant level.

4. Rotary vane pump according to claim 1, wherein the ventilation end of the ventilation channel opens into the lubricant chamber.

5. Rotary vane pump according to claim 1, wherein the discharge channel is configured such that in the operating state of the rotary vane pump said discharge channel opens into the lubricant chamber at least partially below the lubricant level of the lubricant chamber.

6. Rotary vane pump according to claim 1, wherein the lubricant chamber has a lubricant bath, adjacent to the discharge channel, and a lubricant storage area, wherein the lubricant bath and the lubricant storage area are separated from one another by a partition wall.

7. Rotary vane pump according to claim 6, wherein the partition wall has a drain opening and/or a recess in a region of an upper edge of the partition wall.

8. Rotary vane pump according to claim 6, wherein a volume-reducing device is provided in an upper filling level region of the lubricant chamber and/or of the lubricant bath.

9. Rotary vane pump according to claim 1, wherein the valve device is configured at least in some areas as a valve tongue device.

10. Rotary vane pump according to claim 1, comprising a plurality of intake channels and/or discharge channels and/or valve devices and/or valve tongue devices and/or ventilation channels and/or compensation channels and/or conveying chambers and/or rotors and/or rotor receiving chambers.

11. Rotary vane pump according to claim 1, wherein the ventilation channel and/or the compensation channel comprises a fluid flow rate limiting device.

12. Rotary vane pump according to claim 11, wherein said valve device is configured as a sealing valve device, and said valve tongue device is configured to be substantially free of recesses.

13. Rotary vane pump according to claim 6, wherein a dimensioning of a volume of the lubricant bath is selected such that a lowering of the lubricant level during a transition from the operating state to the resting state of the rotary vane pump is realized by an initial lubricant transfer out of the lubricant chamber and/or the lubricant bath via the compensation channel into the conveying chamber, whereby maximum lubricant transfer into the conveying chamber is dimensioned such that a restart of the rotary vane pump is not impaired by the lubricant present in the conveying chamber.

14. Rotary vane pump according claim 6, wherein the rotary vane pump is configured such that a relative arrangement of lubricant level in the lubricant chamber and/or in the lubricant bath on the one hand, and in the discharge channel and/or the compensation end of the compensation channel on the other hand, results from a variation of the lubricant level.

15. Rotary vane pump according to claim 1, wherein the conveying chamber is at least partially delimited by wall elements which are slidable and/or pivotable relative to the rotor.

16. Rotary vane pump according to claim 11, wherein the fluid flow rate limiting device of the ventilation channel is dimensioned such that in the operating state of the rotary vane pump a noise reduction is realized without significant impairment of a conveying capacity of the rotary vane pump.

17. Rotary vane pump according to claim 11, wherein the fluid flow rate limiting device of the compensation channel is dimensioned such that sufficient ventilation of the conveying chamber is realized during a shutdown of the rotary vane pump without significant impairment of the operating state by lubricant flowing back through the compensation channel and/or the fluid to be conveyed.

* * * * *